US008457336B2

(12) United States Patent
Ladabaum et al.

(10) Patent No.: US 8,457,336 B2
(45) **Date of Patent: *Jun. 4, 2013**

(54) CONTAMINATION RESISTANT PORTS FOR HEARING DEVICES

(75) Inventors: Igal Ladabaum, San Carlos, CA (US); Stuart Wenzel, San Carlos, CA (US); Ganapati Mauze, Sunnyvale, CA (US); Ian Michael Day, Fremont, CA (US); Leland Stock, San Francisco, CA (US); Paul Wagner, San Carlos, CA (US)

(73) Assignee: InSound Medical, Inc., Newark, CA (US)

( * ) Notice: Subject to any disclaimer, the term of this patent is extended or adjusted under 35 U.S.C. 154(b) by 197 days.

This patent is subject to a terminal disclaimer.

(21) Appl. No.: 12/819,066

(22) Filed: Jun. 18, 2010

(65) Prior Publication Data

US 2010/0322452 A1 Dec. 23, 2010

Related U.S. Application Data

(63) Continuation-in-part of application No. 11/874,011, filed on Oct. 17, 2007, now Pat. No. 8,036,407, which is a continuation of application No. 11/053,656, filed on Feb. 7, 2005, now Pat. No. 7,298,857.

(60) Provisional application No. 61/218,591, filed on Jun. 19, 2009, provisional application No. 60/542,776, filed on Feb. 5, 2004.

(51) Int. Cl.
*H04R 25/00* (2006.01)

(52) U.S. Cl.
USPC ..... 381/328; 381/324

(58) Field of Classification Search
USPC ..... 181/129, 130, 135; 381/324, 325, 381/328
See application file for complete search history.

(56) References Cited

U.S. PATENT DOCUMENTS

| | | | |
|---|---|---|---|
| 3,061,689 | A | 10/1962 | McCarrell et al. |
| RE26,258 | E | 8/1967 | Martin |
| 3,414,685 | A | 12/1968 | Geib et al. |
| 3,527,901 | A | 9/1970 | Geib |
| 3,594,514 | A | 7/1971 | Wingrove |
| 3,764,748 | A | 10/1973 | Branch et al. |

(Continued)

FOREIGN PATENT DOCUMENTS

WO WO 00/52964 A2 9/2000

OTHER PUBLICATIONS

US 5,730,699, 03/1993, Adams et al. (withdrawn).

(Continued)

*Primary Examiner* — Mohammad Islam
*Assistant Examiner* — Phylesha Dabney
(74) *Attorney, Agent, or Firm* — Henricks, Slavin & Holmes LLP

(57) ABSTRACT

An in-canal hearing device includes a receiver, battery, and microphone assembly with a housing. The housing has an air and sound opening which is covered with a structure to inhibit the entry of cerumen and moisture. The structure may be in the form of an end cap having passages with walls which are both hydrophobic and oleophobic to prevent the entry of water, cerumen and other liquids. The structure may also include a flexible tube or a rigid perforated shell surrounding the passages that inhibit the deposition of solid cerumen and other debris onto the passages.

36 Claims, 14 Drawing Sheets

U.S. PATENT DOCUMENTS

| | | | | |
|---|---|---|---|---|
| 3,783,201 | A | 1/1974 | Weiss et al. | |
| 3,865,998 | A | 2/1975 | Weiss et al. | |
| 3,870,832 | A | 3/1975 | Fredrickson | |
| 3,882,285 | A | 5/1975 | Nunley et al. | |
| 4,442,917 | A | 4/1984 | Johnson | |
| 4,539,440 | A | 9/1985 | Sciarra | |
| 4,606,329 | A | 8/1986 | Hough | |
| 4,607,720 | A | 8/1986 | Hardt | |
| 4,628,907 | A | 12/1986 | Epley | |
| 4,639,556 | A | 1/1987 | Hartl et al. | |
| 4,680,799 | A | 7/1987 | Henneberger | |
| 4,756,312 | A | 7/1988 | Epley | |
| 4,776,322 | A | 10/1988 | Hough et al. | |
| 4,817,607 | A | 4/1989 | Tatge | |
| 4,817,609 | A | 4/1989 | Perkins et al. | |
| 4,830,139 | A | 5/1989 | Cirillo | |
| 4,840,178 | A | 6/1989 | Heide et al. | |
| 4,870,688 | A | 9/1989 | Voroba et al. | |
| 4,880,076 | A | 11/1989 | Ahlberg et al. | |
| 4,937,876 | A | 6/1990 | Biermans | |
| 4,957,478 | A | 9/1990 | Maniglia | |
| 4,972,488 | A | 11/1990 | Weiss et al. | |
| 4,984,277 | A | 1/1991 | Bisgaard et al. | |
| 5,002,151 | A | 3/1991 | Oliveira et al. | |
| 5,015,224 | A | 5/1991 | Maniglia | |
| 5,015,225 | A | 5/1991 | Hough et al. | |
| 5,163,957 | A | 11/1992 | Sade et al. | |
| 5,220,612 | A | 6/1993 | Tibbetts et al. | |
| 5,220,918 | A | 6/1993 | Heide et al. | |
| 5,259,032 | A | 11/1993 | Perkins et al. | |
| 5,282,858 | A | 2/1994 | Bisch et al. | |
| 5,338,287 | A | 8/1994 | Miller et al. | |
| 5,390,254 | A | 2/1995 | Adelman | |
| 5,401,920 | A | 3/1995 | Oliveira | |
| 5,425,104 | A | 6/1995 | Shennib | |
| 5,430,801 | A | 7/1995 | Hill | |
| 5,456,654 | A | 10/1995 | Ball | |
| 5,531,787 | A | 7/1996 | Lesinski et al. | |
| 5,554,096 | A | 9/1996 | Ball | |
| 5,624,376 | A | 4/1997 | Ball et al. | |
| 5,654,530 | A | 8/1997 | Sauer et al. | |
| 5,659,621 | A | 8/1997 | Newton | |
| 5,682,020 | A | 10/1997 | Oliveira | |
| 5,701,348 | A | 12/1997 | Shennib et al. | |
| 5,742,692 | A | 4/1998 | Garcia | |
| 5,825,896 | A | 10/1998 | Leedom | |
| 5,833,626 | A | 11/1998 | Leysieffer | |
| 5,949,895 | A | 9/1999 | Ball et al. | |
| 5,982,908 | A | 11/1999 | Bauman | |
| 6,058,198 | A | 5/2000 | Aceti et al. | |
| 6,137,889 | A | 10/2000 | Shennib et al. | |
| 6,208,741 | B1 | 3/2001 | Shennib et al. | |
| 6,212,283 | B1 | 4/2001 | Fletcher et al. | |
| 6,408,081 | B1 | 6/2002 | Boesen | |
| 6,449,373 | B2 | 9/2002 | Baker | |
| 6,473,513 | B1 | 10/2002 | Shennib et al. | |
| 6,595,796 | B1 | 7/2003 | Koegel et al. | |
| 6,620,110 | B2 | 9/2003 | Schmid | |
| 6,643,378 | B2 | 11/2003 | Schumaier | |
| 6,648,813 | B2 | 11/2003 | Zilberman et al. | |
| 6,658,126 | B1 | 12/2003 | Stern | |
| 6,738,488 | B1 | 5/2004 | Baker | |
| 6,932,187 | B2 * | 8/2005 | Banter et al. | 181/149 |
| 6,940,988 | B1 | 9/2005 | Shennib et al. | |
| 7,215,789 | B2 | 5/2007 | Shennib et al. | |
| 7,283,640 | B2 * | 10/2007 | Karamuk | 381/322 |
| 7,298,857 | B2 | 11/2007 | Shennib et al. | |
| 7,329,933 | B2 | 2/2008 | Zhe et al. | |
| 7,379,555 | B2 | 5/2008 | Gable et al. | |
| 7,388,961 | B2 | 6/2008 | Shennib et al. | |
| 7,466,836 | B2 * | 12/2008 | Tilson et al. | 381/329 |
| 7,551,747 | B2 * | 6/2009 | Huynh et al. | 381/325 |
| 7,558,394 | B2 * | 7/2009 | Tilson et al. | 381/325 |
| 2005/0249370 | A1 | 11/2005 | Shennib et al. | |
| 2005/0259840 | A1 | 11/2005 | Gable et al. | |
| 2005/0286731 | A1 | 12/2005 | Shennib et al. | |
| 2006/0036470 | A1 | 2/2006 | Oaks | |
| 2006/0050914 | A1 | 3/2006 | Urso | |
| 2007/0003084 | A1 | 1/2007 | Huynh et al. | |
| 2008/0031482 | A1 | 2/2008 | Shennib et al. | |
| 2009/0092270 | A1 * | 4/2009 | Ho et al. | 381/324 |
| 2009/0238389 | A1 * | 9/2009 | Tilson et al. | 381/328 |
| 2010/0086159 | A1 * | 4/2010 | Gabathuler et al. | 381/328 |
| 2010/0322452 | A1 * | 12/2010 | Ladabaum et al. | 381/375 |

OTHER PUBLICATIONS

International Search Report and Written Opinion of PCT Application No. PCT/US2010/039375, mailed Aug. 17, 2010, 7 pages total.

Ballachanda, The Human Ear Canal, Singular Publishing, 1950, pp. 195.

Chasin, CIC Handbook, Singular Publishing Group, Inc. (1997), pp. 5, 9-14, 17-18, 27-28, 44, 56-58, and 65-66.

Oliveira, et al, "The Wax Problem: Two New Approaches," The Hearing Journal, 1993; 46(8: 41-46, 48.

Plawsky et al., "Review of the effects of surface topography, surface chemistry and fluid physics on evaporation at the contact line," Chem. Eng. Comm, 2008; 196(5):658-696.

Siemens Hearing Instruments, Inc., General Information for Hearing aid Users, Mar. 1998, p. 1-14.

Valente, Strategies for Selecting and Verging Hearing Aid Fittings, Theme Medical Publishing. pp. 255-256, 1994.

Widex Hearing Aid Co, Users's Instructions, Senso CIC and Mini Canal. Feb. 1997, pp. 2-27.

* cited by examiner

CONTAMINATION RESISTANT PORTS FOR HEARING DEVICES

CROSS-REFERENCES TO RELATED APPLICATIONS

This application claims the benefit of Provisional Application No. 61/218,591 filed on Jun. 19, 2009, and is a continuation-in-part of Application No. 11/874,011, filed on Oct. 12, 2007, now U.S. Patent No. 8,036,407, which was a continuation of U.S. Application No. 11/053,656, filed Feb. 7, 2005, now U.S. Pat. No. 7,298,857, which claimed the benefit of U.S. Provisional Application Ser. No. 60/542,776, filed on Feb. 5, 2004, the full disclosures of which are incorporated herein by reference.

The application is related to but does not claim the benefit of the following: U.S. Pat. No. 6,473,513 issued Oct. 29, 2002; U.S. Pat. No. 6,940,988, issued Sep. 6, 2005; U.S. Pat. No. 7,379,555, issued May 27, 2008; U.S. Pat. No. 7,388,961, issued Jun. 17, 2008; and U.S. Pat. No. 7,551,747, issued on Jun. 23, 2009, the full disclosures of which are incorporated herein by reference.

BACKGROUND OF THE INVENTION

The present invention is directed toward improving the resistance of hearing device sound ports to contamination. More specifically, the invention is directed toward improving the resistance of "completely in the canal" (CIC) hearing devices to ear wax (i.e. cerumen, which is produced in the ear) and water which can impinge on the sound ports from a shower, a pool, or perspiration from outside or within the ear.

The vast majority of hearing assistance devices are air conduction hearing aids, meaning that sound enters the device via the air and is transmitted from the device to the tympanic membrane of the patient via air. Sound waves traveling in the air impinge on a microphone which generates an electrical signal that is processed, amplified, and drives a speaker (called the "receiver" in the hearing aid art) which sends amplified and processed sound waves in air toward the tympanic membrane of the patient. Thus, most hearing aids have a sound port for the microphone and a sound port for the receiver. If these sound ports get plugged or otherwise compromised by contaminants, the hearing aid's performance degrades.

The nature of contaminants that can affect sound ports depend on the location of the sound ports, which in turn depends on the type of hearing aid. For example, the microphone port in a conventional BTE (Behind The Ear) device is located on the module suspended on the pinna, and is susceptible to water and debris from the environment and hair, but is not susceptible to wax. In contrast, the receiver port of a conventional CIC (completely in the canal) hearing aid is susceptible to cerumen and moisture produced in the cartilaginous portion of the ear canal where the receiver port is typically located. It is desirable to have sound ports that are resistant to contamination and do not distort the acoustic signals as the sound waves pass through the ports. Hearing aid designers and manufacturers have attempted many approaches, but none of the approaches attempted to date meets the requirements of extended wear CIC hearing aids which are worn deep in the canal for extended periods of weeks or months.

Extended wear hearing devices, such as those described in U.S. Pat. No. 7,215,789 to Shennib et al., U.S. Pat. No. 6,940,988 to Shennib et al., and U.S. Pat. No. 6,473,513 to Shennib et al., are worn continuously for periods from several weeks to several months inside the ear canal. These devices as taught by Shennib et al. are miniature in size in order to fit entirely within the ear canal and are adapted for the receiver to fit deeply in the ear canal in proximity to the tympanic membrane (TM). However, the devices' microphone port, as taught, is exposed to the cartilaginous portion of the canal, and consequently the cerumen, moisture, and debris that could be present.

In U.S. Pat. No. 6,738,488, Baker teaches a hearing aid with features to protect the receiver sound port. Features include a tortuous path that allows sound to reach the eardrum, but impede the flow of cerumen to the receiver. Additional features include a shield, and a mesh, also to stop cerumen Inherent in the design is the need to remove the device and clean the mesh and shield in the event it gets clogged by cerumen, which Baker acknowledges is likely. With regard to protection from water, the teaching is less convincing because it requires a particular orientation of the hearing device with respect to gravity, and during an average wearer's day, the head can be in may orientations with respect to gravity. Furthermore, the local forces of capillary action, fluid adhesion, and fluid cohesion are not discussed, and in fact dominate the effect of gravity. The designs of the Baker's patent would not pass a high fidelity signal into a microphone, nor would they protect a device that remains in the ear for extended periods from wax and water.

In U.S. Pat. No. 4,984,277, Bisgaard et al teach a protection element for an all-in-the-ear hearing aid. The protection element is properly designed acoustically, but contains a wax filter which is replaced. Replacement of the filter requires the removal of the device from the ear and special tooling. The approach of Bisgaard and similar filter methods are therefore not appropriate for a device that is intended to remain in the ear for extended periods without cleaning the device.

In U.S. Pat. No. 4,972,488, Weiss and Stanton teach protection schemes based on tortuous paths similar to those of Baker. The teachings acknowledge that such tortuous paths will have an impact on the acoustic transfer function. Most significantly, in the Weiss patent as well as the Bisgaard and Baker patents, emphasis is placed only on wax protection. Water and moisture are not considered, and in fact water would flood and wick into the protection schemes without additional precautions due to capillary action in the tortuous paths.

In order to design sound ports resistant to the relatively hostile environment of the ear canal, all of water, soapy water, perspiration, cerumen and debris need to be considered.

SUMMARY OF THE INVENTION

The present invention, illustrated with preferred embodiments directed toward a deep in the ear canal device, provides for high fidelity contamination resistant sound ports. The deep in the canal, extended wear devices, such as those described in the Shennib patents referenced above, place the receiver so deep in the canal that it is insulated from most potential contaminants in the cartilaginous region by the retaining seals, and it is the microphone (input) sound port that requires protection. The device may also have an air cathode battery requiring oxygen, which should also pass unimpeded across the input sound port. While such sound/air ports will typically benefit the most from the improvements of the present invention, they can also be used with the receiver output and any other ports that may be found in the device housing. They may also be used with batteries and other power sources that do not require air or oxygen.

While primarily intended for extended wear CIC devices, as disclosed in the preferred embodiments, the present invention could also be used to protect the sound ports of monitor microphones, receiver in the canal devices, and other air conduction hearing aid and device configurations. Furthermore, the invention could be used to protect an air access port in a housing for zinc air batteries of the type typically used with hearing aids.

It is the objective of this invention to provide sound and other ports for hearing devices that are resistant to contamination.

Another objective of this invention is to provide a miniature port enabling both unimpaired sound transmission into a microphone of a miniature hearing device and access to oxygen for an air cathode battery, while at the same time blocking the ingress of liquids and solids, especially cerumen, water, sweat, and soapy water.

Another objective is to provide a miniature sound port whose surrounding material is engineered to wick deposits away from the port and prevent build-up that could eventually clog the port.

Another objective is to provide an extended wear hearing assist device which is not susceptible to deterioration from wax, water, and sweat for a period of at least two months.

Another objective is to provide an extended wear canal device which is entirely within the bony portion, but whose sound port could on occasion be exposed to contaminants secreted in the cartilaginous portion of the canal.

Another objective is to provide an extended wear canal device whose sound and air entry point is in the cartilaginous portion.

The above objectives are achieved at least in part by designs of the present invention as described below. By placing two hydrophobic surfaces opposite each other, a capillary barrier is created, i.e., a structure which provides a mechanism which is the opposite of capillary action. That is, each surface will have a water droplet contact angle greater than 90 degrees (a formal definition of hydrophobicity). When these surfaces are placed close together, typically separated by a distance in the range from 0.001 inch to 0.1 inch, water entering into the space between the surfaces will be inhibited. Similarly, oleophobic surfaces with a lipid droplet contact angle greater than 90 degrees and a spacing in the range from 0.001 inch to 0.1 inch will not allow liquid phase lipid substances such as cerumen to enter. Solid phase cerumen, typically in the form of chunks or particles, may be blocked by other barriers as described in more detail below.

Surfaces that are both oleophobic and hydrophobic can be created by modifying the surface wettability and/or geometry of the opposing surfaces. Coatings which are hydrophobic (water droplet contact angle greater than 90 degrees) and somewhat oleophobic (lipid or oil droplet contact angle greater than 60 degrees but less than 90 degrees), can be used for simpler resistant ports without the need of surface geometry modifications. The term "oleophobic" as used herein to describe surfaces and coatings will include both surfaces and coatings which are fully oleophobic (lipid droplet contact angle greater than or equal to 90 degrees) and surfaces and coatings which are partially oleophobic (lipid droplet contact angle greater than 60 degrees but less than 90 degrees).

The present invention provides optimized geometric arrangements, dimensions and/or coatings of the opposed surfaces to create openings that pass sound waves with minimum attenuation and air/oxygen in sufficient quantity to permit functioning of metal air batteries while blocking liquids, including mixtures of water, cerumen, soap, salt and other contaminants that are often found in the ear canal. Furthermore, in the event that contaminant deposits start to collect around the sound port and potentially block it, the present invention can provide "wettability gradients" that can wick or draw contaminants away from areas which can block the port or otherwise interfere with operation of the hearing device to regions where the contaminants will not be problematic.

In addition to creating surface-modified channels and ports for creating contaminant barriers while allowing the passage of air and sound waves, the present invention provides for additional barriers which prevent larger pieces of cerumen and other contaminants from blocking or clogging the passages. In particular, surrounding walls, typically in the form of open-ended tubular coverings, may be placed so that they surround the hydrophobic/oleophobic barriers that prevent liquid contaminants from entering the in-canal hearing device. These surrounding wall structures are typically compliant or elastic, usually being formed from elastomers, so that they are more comfortable in the ear canal and are able to bend and reconfigure so that the open ends remain clear and free from cerumen and other large pieces of debris. The surrounding wall structures further prevent hair found in the cartilaginous portion of the ear canal from entering the sound port passages.

While the hearing devices of the present invention will benefit from both the hydrophobic/oleophobic liquid and vapor barrier and the surrounding wall cerumen barrier even if used individually, used together they provide a very high degree of protection against blocking and clogging of the open passages and channels of such devices.

BRIEF DESCRIPTION OF THE DRAWINGS

FIG. 15D is a modification with a bridge over the screen.

DETAILED DESCRIPTION OF THE INVENTION

Embodiments of the invention provide housings for hearing device components, where the housings have an interior and an exterior, with a sound/air port (which will typically include an opening or aperture through the housing) that defines an air exchange path which provides sound and air communication between the interior and exterior of the housing. In particular, the present invention comprises structures, coatings, and/or other surface modifications which create resistance to contamination of the sound/air port which can occur when the housing is worn in the ear canal, often for extended time periods of days, weeks, or months. More particularly, the present invention provides an extended wear "completely in the canal" (CIC) hearing aid having a microphone assembly and/or a metal air battery in the interior of the housing that open to the ear canal through the sound/air port which is resistant to fouling by contaminants typically present in the ear canal, such as water, liquid and solid cerumen, and other ear canal debris, allowing the device to be worn for extended periods of time without removal for cleaning, battery replacement or other maintenance.

Figure 1:
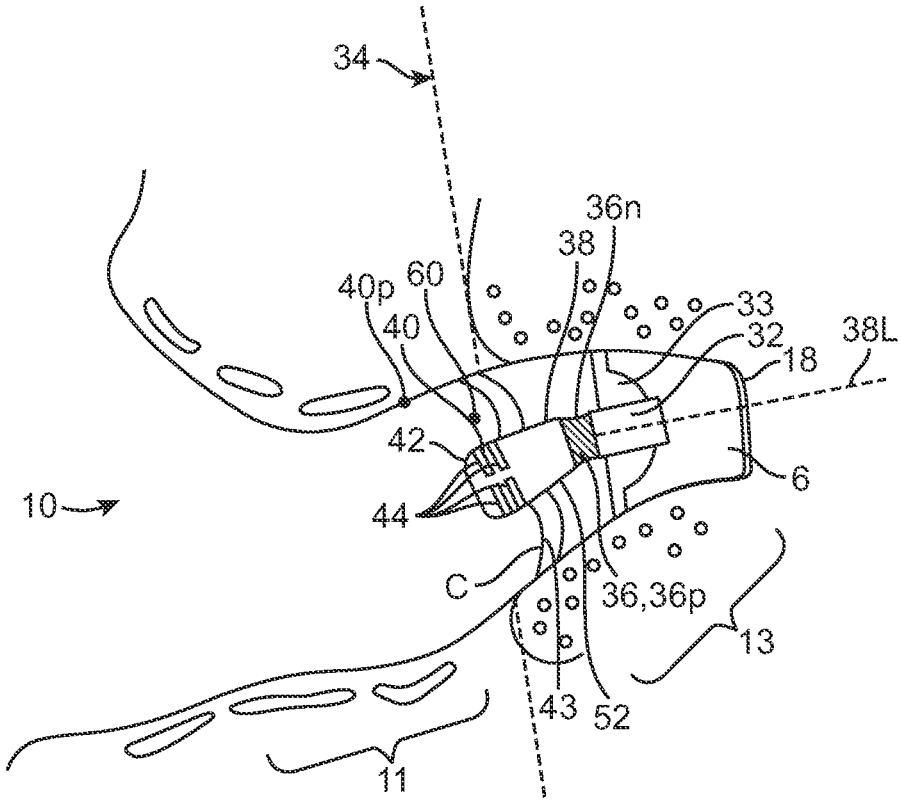
FIG. 1 is a cross-sectional view of the ear canal with an extended wear device retained entirely in the bony portion.
Figure 1A:
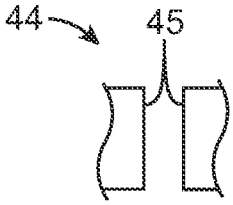
FIG. 1A is a detailed view of a sound/air aperture of the device of FIG. 1.

Referring now to FIG. 1, an embodiment of a CIC hearing aid device 38 configured for placement and use in ear canal 10 can include a receiver (or speaker) assembly 32, a microphone assembly 42 and a battery assembly 52. Preferably, device 38 is configured for placement and use in or near the bony region 13 of canal 10 so as to minimize acoustical occlusion effects due to residual volume of air in the ear canal between device 38 and tympanic membrane 18. For example, device 38 may be positioned medially from bony junction 34. The occlusion effects are inversely proportional to residual volume 6; therefore, they can be minimized by placement of device 38 in the bony region 13 so as to minimize volume 6.

Receiver assembly 32 is configured to supply acoustical signals received from the microphone assembly 42 to the tympanic membrane 18 of the wearer of the device. The microphone assembly 42 includes a microphone 40 and microphone sound ports 44 through which sound waves enter the microphone and air reaches the battery assembly 52 (which will usually include an air-metal battery which requires a supply of air to produce current). The microphone 40 is configured to receive incoming acoustic signals. One or both of the receiver assembly or microphone assembly can include sealing retainers 33 and 43. Battery assembly 52 and speaker assembly 32 can be coupled by a coupling 36.

Battery assembly 52 includes a battery (not shown) configured to provide power to hearing device 38 for an extended periods of operation and is thus desirably a high capacity battery. In many embodiments the battery is a metal air battery which has an electrochemistry that utilizes oxygen to generate electricity. Accordingly, in such embodiments, air can enter through the sound ports 44 and/or the battery assembly 52 can include a battery vent though which air including oxygen can enter the battery. Example metal air batteries include, but are not limited to, aluminum, calcium, iron, lithium, magnesium-air based battery. In a preferred embodiment, the battery is a zinc-air battery known in the art. In alternative embodiments, the battery can employ a variety of electrochemistry known in the art including, but not limited to, lithium, lithium polymer, lithium ion, nickel cadmium, nickel metal hydride, or lead acid or combinations thereof.

In many embodiments, the microphone assembly 42 and battery assembly 52 are positioned in the ear canal such that surrounding air volume 60 is fluidically coupled to the battery and microphone via sound port 44 and battery vent (if present). This allows sound waves to reach the sound port and oxygen to reach the battery vent.

Figure 2:
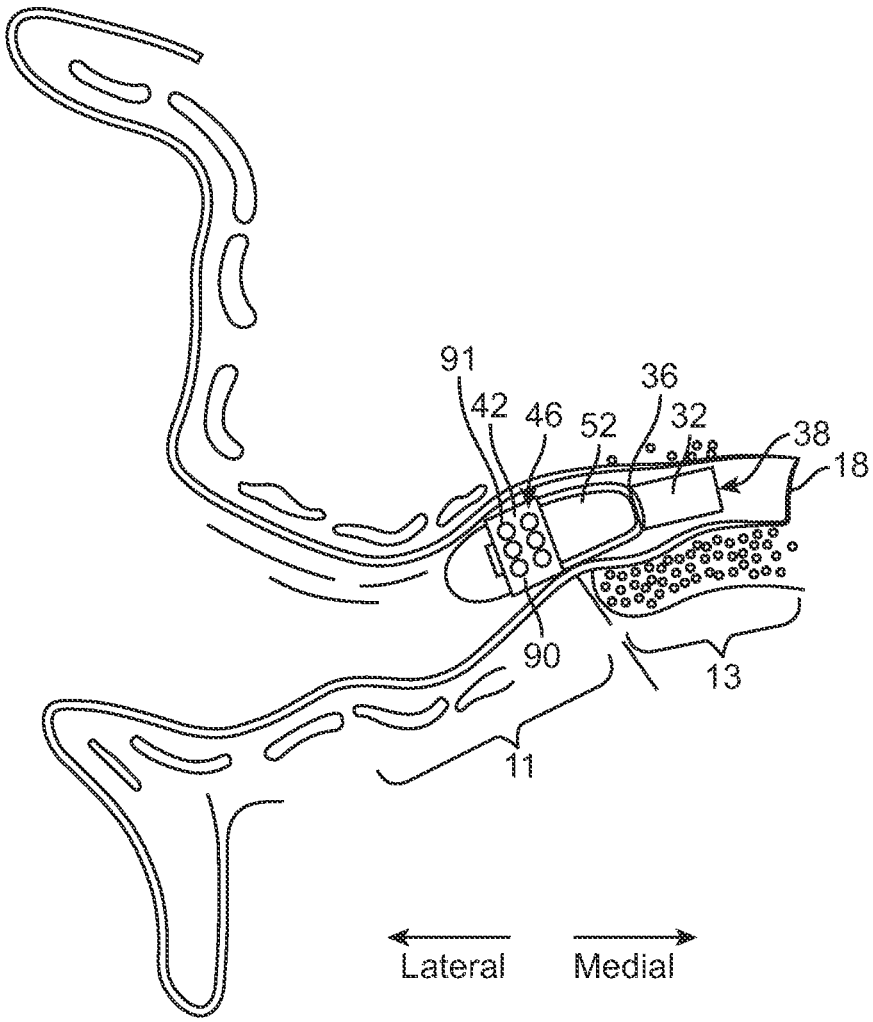
FIG. 2 illustrates a device having a microphone port extending into the cartilaginous region.

Referring now to FIG. 2, an alternative hearing device 38 comprise a housing 46 with a protective cap 90. The cap 90 is configured to be mounted over or otherwise coupled to at a lateral end of hearing device 38. In many embodiments, the cap 90 will be configured to mount over most or all of microphone assembly 42. However, the cap 90 can also be configured to be mounted over portions of battery assembly 52 and even portions of receiver assembly 32. In a preferred embodiment, the cap 90 is configured to mount over all of microphone assembly 42 and a portion of battery assembly 52. In particular embodiments, the cap 90 can be configured to mounted over and even form a seal with the battery assembly 52 or components thereof.

The cap 90 can have a variety of shapes including, but not limited to, cylindrical, semi-spherical and thimble shaped. In a preferred embodiment, the cap 90 is substantially cylindrically shaped and includes a side wall portion and an interior or cavity portion, microphone assembly 42 and battery assembly 52 may be positioned within the interior or cavity portion. In many embodiments, the cap includes one or more perforations 91 which can be configured to serves as channels for ventilation for moisture reduction, oxygen supply to the battery, and acoustical conduction as is discussed herein. Perforations 91 can be positioned in various locations throughout the cap but are preferentially positioned in patterns on the top and sides of the cap. All or portions of cap 90, including the walls of the perforations, can include a protective coating which can be configured to be hydrophobic, oleophobic, and cerumenophobic to prevent or minimize water, oils and cerumen from entering the cavity.

In many embodiments, the cap interior has a sufficient volume and shape to serve as a receptacle for various components of hearing aid 38 including, but not limited to, microphone assembly 42 and associated integrated circuit assemblies, battery assembly 52, receiver assembly 32 and electrical harnesses or connections for one or more hearing aid components. After the component or components are placed within the cap interior, a setting or encapsulation material can be added. In a preferred embodiment, the cap is configured to serve as a receptacle to the microphone assembly when the microphone is oriented in a medial direction of the ear canal. In such embodiments, the cap is also configured to provide sufficient acoustical transmittance to the microphone assembly such that the hearing aid provides adequate function to the user (e.g., amplification, frequency response, etc).

Figure 3:
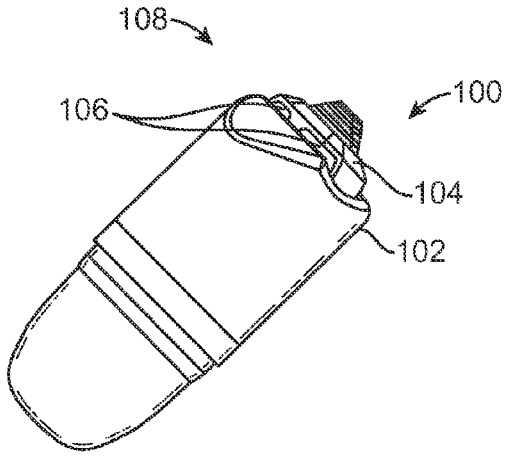
FIG. 3 is a perspective view of a device with a cap providing a protected sound and air (oxygen) input port.

FIG. 3 illustrates a hearing device 100 comprising a housing 102 having a protective cap structure 104 which defines openings or apertures 106 forming a contamination resistant sound port in accordance with the principles of the present invention. The sound port is disposed at the lateral end 108 (oriented outwardly toward the external opening of the ear canal as shown in FIG. 2) of the hearing device 100, to receive air and sound while impeding liquid ingress when placed in the hearing canal of the user.

Figure 4A:
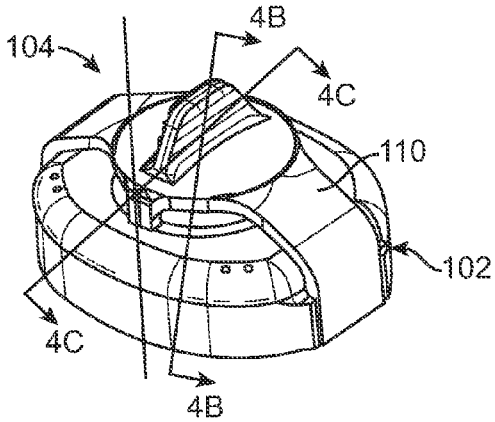
FIG. 4A is a detailed view of the cap of FIG. 3.
Figure 4B:
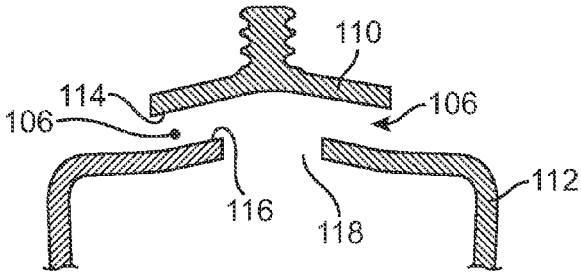
FIG. 4B is a cross section taken along line 4B-4B of FIG. 4A.
Figure 4C:
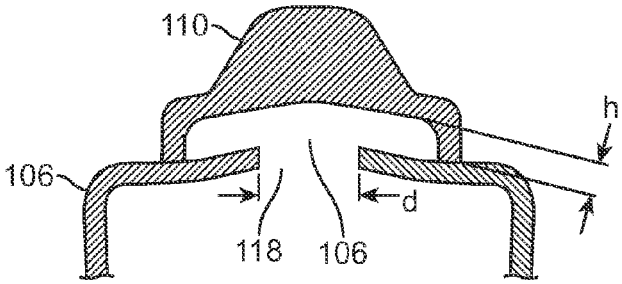
FIG. 4C is a cross section taken along line 4C-4C of FIG. 4A.

FIGS. 4A-4C show detail of an embodiment of the protective cap structure 104 of FIG. 3. Protective cap structure 104 includes a cross member 110 which is suspended over a lateral end 112 of the housing 102 to define the apertures 106 for passing air and sound through a hole 118 in the lateral end to the interior of the hearing device. Cross member 110 creates opposing surfaces or walls 114 and 116, and the apertures 106 and hole 118 together form an air and sound path through which air and sound travel from the exterior of the housing to interior of the hearing device. In one aspect of the present invention, these opposed surfaces 114 and 116 may be modified to enhance both hydrophobicity and oleophobicity to prevent or impede the intrusion of water and liquid lipids and oils, as well as liquid mixtures of these materials and other contaminants that might be present in the ear canal. For example, the surfaces 114 and 116 may be coated with materials which increase hydrophobicity and oleophobicity, such as fluoropolymers including PFC (Cytonics Corp.) and ECG (3M). The surface chemistry may alternately be modified with plasma or chemical techniques to change hydrophobicity or oleophobicity. For example, plasma treatment can be used to fluorinate the surface. As seen in FIG. 4C, the height h of aperture 106 will be selected to achieve a desired degree of capillary pressure to prevent liquid ingress while still allowing sufficient sound passage, typically being in the range 0.001 inch to 0.1 inch with a value of 0.018 inch being presently preferred. The diameter d of the hole 118 will typically be about 0.01 inch to 0.1 inch. Larger, solid pieces of cerumen may be inhibited from entering and blocking the apertures and hole by a surrounding side wall, as described in more detail below.

Figure 5A:
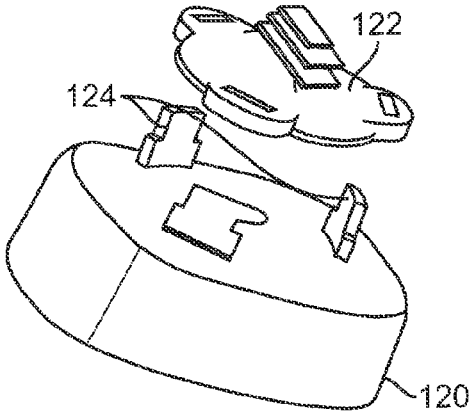
FIGS. 5A and 5B illustrate a method of forming a resistant sound port.
Figure 5B:
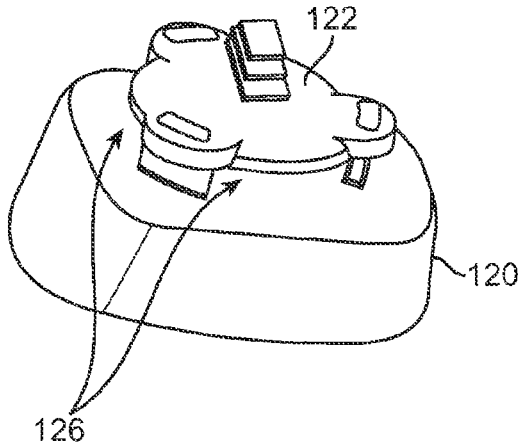

FIGS. 5A and 5B show an alternate cap design where cover 122 is attached to base 120 (which will usually be at or covering a portion of the lateral end of the hearing device housing) via a plurality of tabs 124 to form the desired gap 126 (FIG. 5B).

Figure 6A:
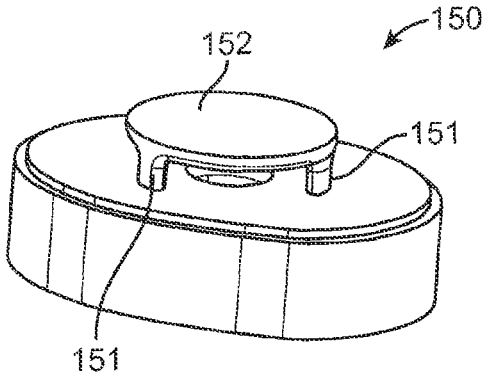
FIGS. 6A and 6B illustrate sound port having a flat cover defining opposed surfaces.
Figure 6B:
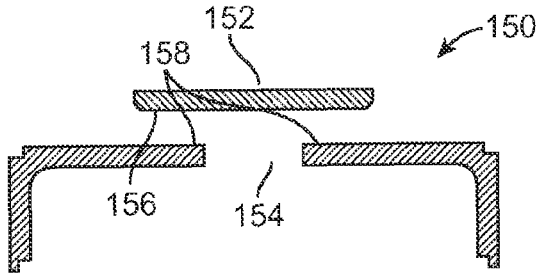

FIGS. 6A and 6B show a further alternative design of an end cap 150 with a flat cover 152 separated from the sound hole 154 by posts 151 attached to the flat cover 152 and forming opposing surfaces 156 and 158.

Figure 7A:
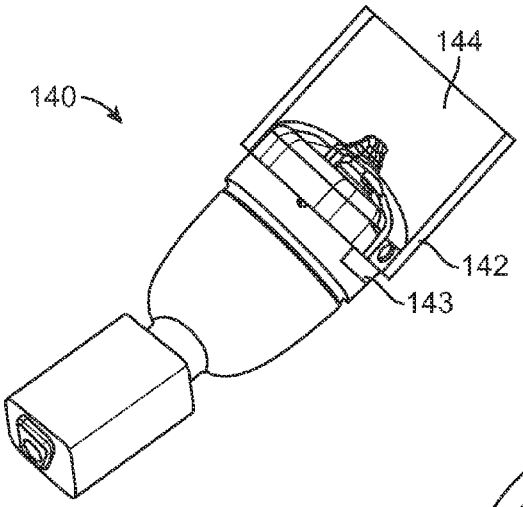
FIGS. 7A to 7C illustrate a sound port protected by a tubular cerumen guard.
Figure 7B:
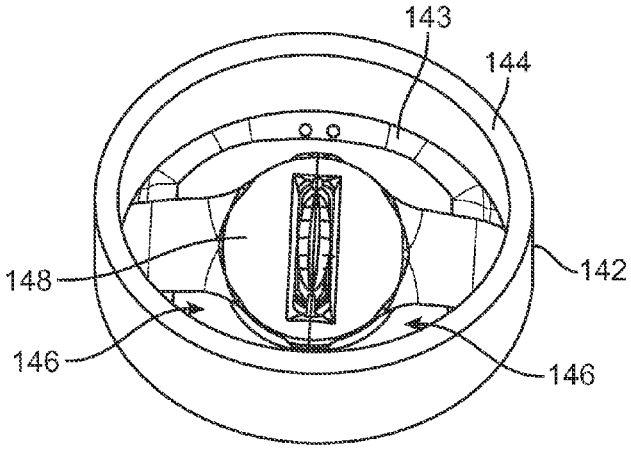
Figure 7C:
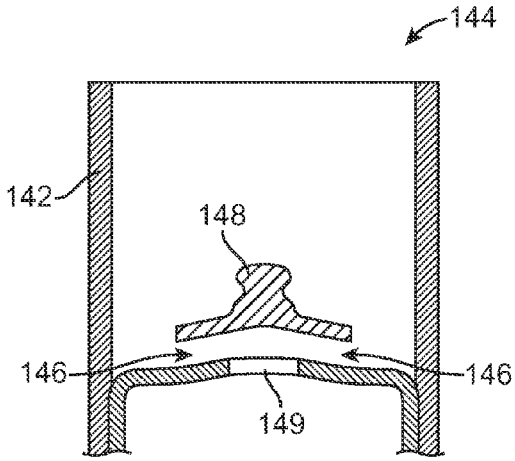

As shown in FIGS. 7A through 7C, in addition to the protective sound ports as described above, a hearing device may have structure to inhibit entry of cerumen particles and other solid debris. For example, a side wall 142 may extend laterally from the lateral end 143 of the device. The side wall 140 has an open end 144, typically being an open-ended tubular structure made of a rubbery or elastomeric material to increase comfort when present in the ear canal. The open end 144 is generally large enough to allow the passage of air and sound with relatively low impedance. The base of the wall may attach around the periphery of the hearing device, as shown, or it may alternately attach to the end face of the hearing device. The side wall 142 helps prevent deposition of solid and viscous liquid cerumen on aperture cap 148 and that might plug the apertures (gaps) 146 and prevent sound and air from reaching the interior of the hearing device through lateral hole 149 (FIG. 7C). A protective feature of side wall 142 is that it can block hair from rubbing around the cap 148. When hair typically found in the cartilaginous region of the canal makes contact with a housing aperture, it can serve as a conduit to deposit cerumen or liquids, or worse, mechanically force contaminants across the port if the cartilaginous portion deflects due to chewing, talking, or other manipulation. The conformability of wall 142 allows the wall to bend, cover and protect cap 148 and gap 146 in response to mechanical flexing of the outer ear while remaining comfortable for the wearer. For example, the wall 142 may be formed from an elastomeric tube having a Shore A durometer in the range from 20 to 30 with a constant wall thickness in the range from 0.15 mm to 0.5 mm and a maximum width or diameter in the range from 4 mm to 10 mm and a lateral extent of 1 to 5 mm. The wall 142 may preferably have an oval cross section to fit over the hearing device without distorting.

Figure 8A:
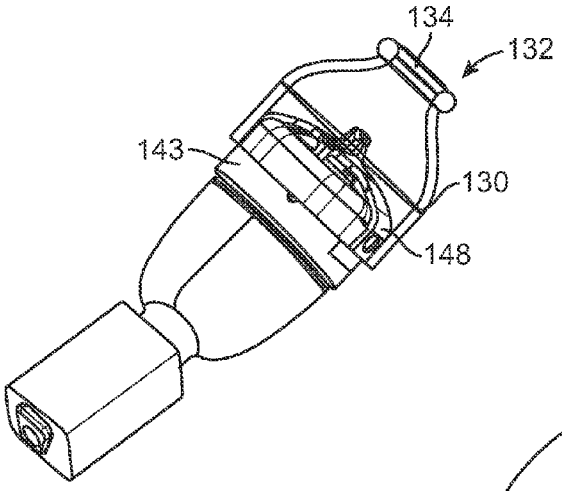
FIGS. 8A to 8C illustrate a sound port protected by a tapered tubular cerumen guard.
Figure 8B:
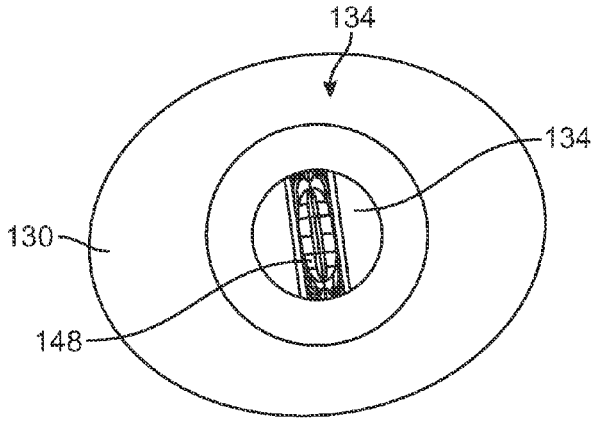
Figure 8C:
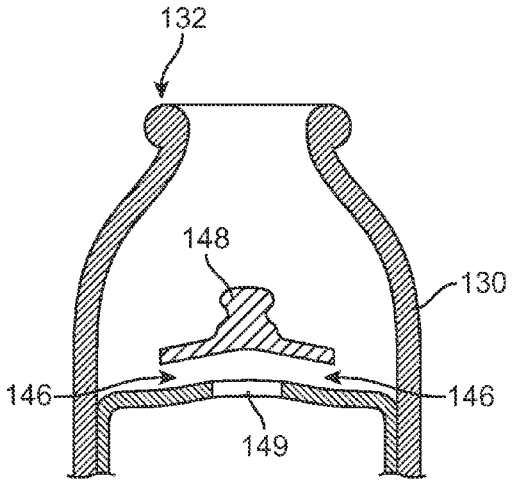

FIGS. 8A through 8C show an alternate side wall 130 construction where a lateral end 132 of the sidewall tapers to a smaller opening 134. The dimensions of the opening 132 are chosen to allow passage of air and sound with relatively low impedance while preventing passage of larger more macroscopic pieces of cerumen. The components of the hearing device are labeled the same as in FIGS. 7A through 7C.

Figure 9A:
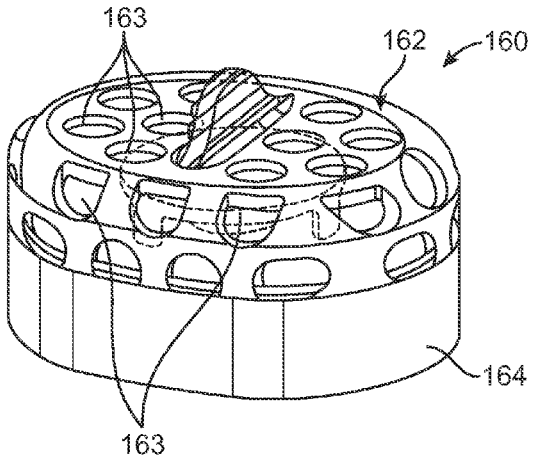
FIGS. 9A and 9B illustrate a protected sound port protected by a rigid cerumen guard having a plurality of holes.
Figure 9B:
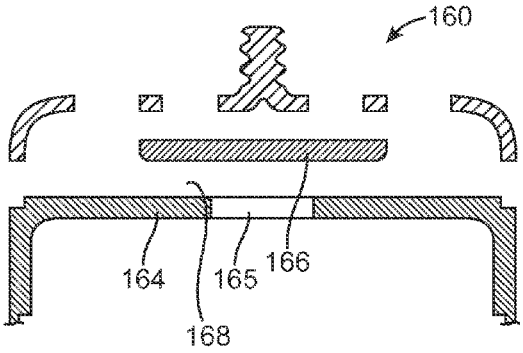

Referring now to FIGS. 9A through 9B, an end cap 160 includes a rigid cerumen guard 162 having a large plurality of holes 163 therethrough. The end cap 160 is disposed over a lateral end 164 of a hearing device housing having a lateral opening 165 and a cover 166 which together form a barrier against the intrusion of water and liquid lipids, e.g. cerumen, as generally described above. The cerumen guard 162 acts much as the side wall previously described to prevent large pieces of cerumen from entering the space 168 between the cover 166 and base 164 to prevent clogging of the opening 165. The holes 163 in cerumen guard 162 also serve a repository for cerumen, preventing it from reaching the sound port. There is a sufficiently large number of holes in the guard, however, so that the likelihood that all or a large percentage of the hole will be blocked during even an extended wearing of many months is quite low.

Figure 10:
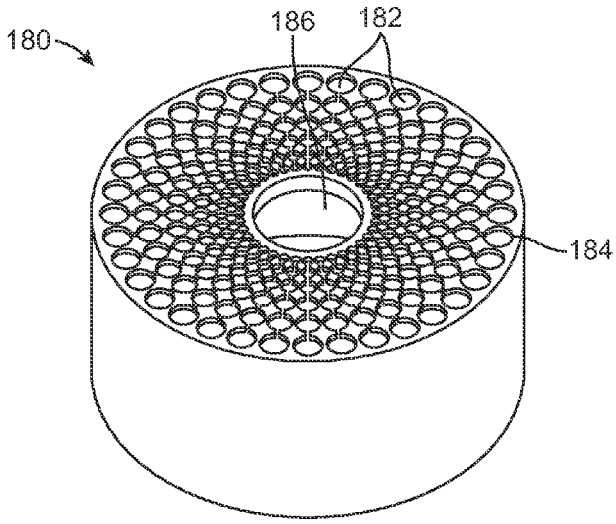
FIG. 10 illustrates a protected sound port with radical with wicking gradients.

Referring now to FIG. 10, an end cap 180 is illustrated with a pattern of channels 182 that create a "wettability" gradient on exposed lateral surface 184 that serves to draw liquids and cerumen away from the sound port. Wetting gradients can be formed by a combination of surface topology and surface-chemistry modification. For example, the surface 184 can be patterned with physical features that change size or shape along radial lines diverging in the direction away from a sound ports or hole 186 to draw fluids away. Surface features include surface roughening as well as forming pillars or holes of varying size. Deep pillars or holes can also collect and store liquids and solids, such cerumen and skin flakes. A spatially patterned hydrophobic or oleophobic coating can also achieve a wetting gradient. In the embodiment of FIG. 10, for example, holes along channels 182 have sharp corners which, potentially in combination with surface chemistry modifications, can serve to draw fluids radially away from the sound hole 186 to the larger outer circles.

In all of the above embodiments, the housings will define passages for permitting the entry of air and sound waves through the aperture of the hearing device enclosure. The surfaces will be modified to be partially or fully hydrophobic and partially or fully oleophobic. Such surface modification may result from coating the surfaces with materials which are at least partially hydrophobic and at least partially oleophobic. Alternatively or additionally, the surfaces may be modified to have surface features which physically impact the collection and wetting of water and cerumen to inhibit passage of these materials over the surfaces or between opposed surfaces.

Figure 11A:
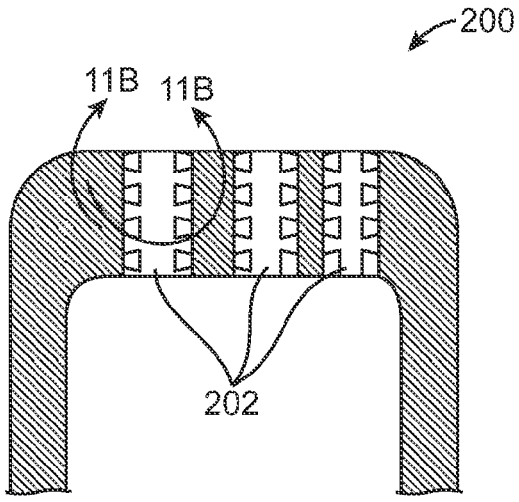
FIGS. 11A to 11C illustrate exemplary surface features which provide hydrophobicity and oleophobicity.
Figure 11B:
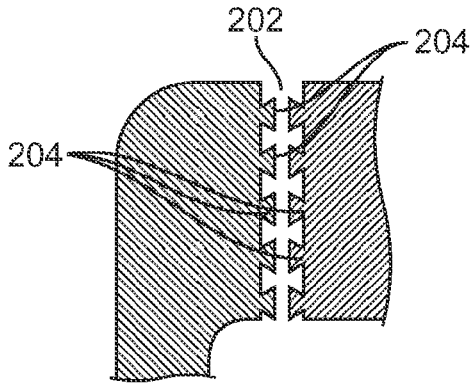
Figure 11C:
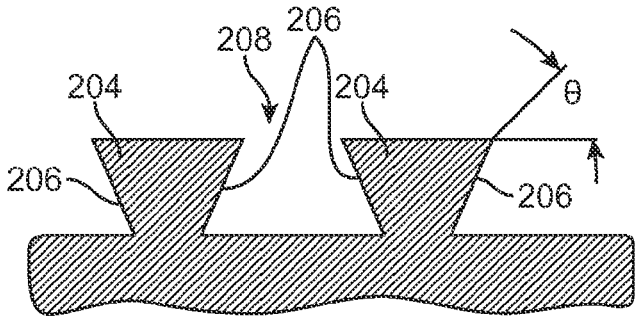

Referring to FIGS. 11A through 11C, an end cap (or lateral end of a hearing device housing) 200 includes a plurality of apertures 202 having the surfaces with surface features, such as micro pillars 204, formed thereover to enhance both hydrophobicity and oleophobicity. Suitable surface features are described in the scientific literature. See, for example, Plawsky et al., *Chem. Eng. Comm.* 196:658-696 (2008). As shown in FIG. 11C, by providing surface pillars 204 having walls 206 which diverge at a re-entrant angle $\theta_{OH}$ which is less than an angle $\theta\gamma$ (the contact angle of the liquid on the flat surface), the fluid will partially enter the opening through the gap 208 and be held by surface tension to inhibit the liquid from spreading across and fully wetting the surface. A preferred embodiment is a re-entrant angle $30° < \theta_{OH} < 90°$. The pillars may be less than about 1 micrometer to over 100 micrometers in width and depth, with a preferred embodiment of about 50 micrometers in width and depth. In addition to the pillars, the features may be formed as holes or slots that may have a similar re-entrant profile. The holes and slots may be about 0.01 mm to 2 mm in diameter and width.

Figure 12A:
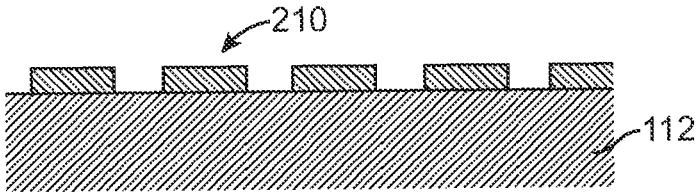
FIGS. 12A to 12E illustrate a method for forming cylindrical or round features on a surface.
Figure 12B:
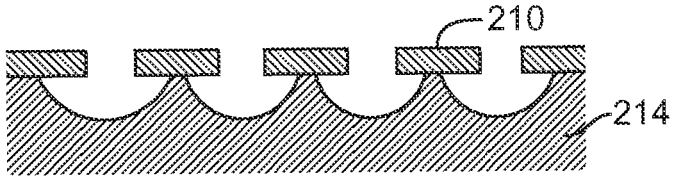
Figure 12C:
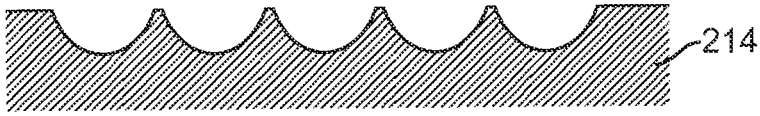
Figure 12D:
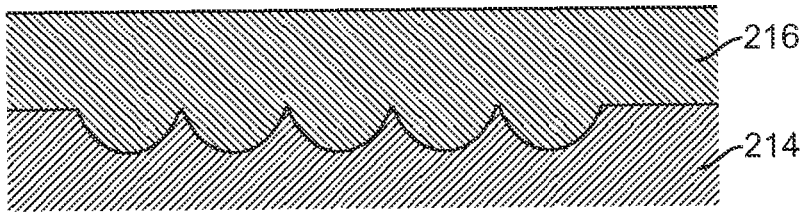

Referring now to FIGS. 12A through 12E, other features, such as in the form of half cylindrical ridges, may be formed by creating a mold and using the mold to form the surfaces by a conventional technique such as hot embossing or injection molding. For example, a patterned resist 210 is formed over a substrate 212 and is isotropically etched (FIG. 12 B) to produce a master 214 for the mold (FIG. 12C). The master 214 is then used to mold the cap or housing material 216 to produce a surface 218 (FIG. 12E) with the desired half cylindrical surfaces 220. Surface features may also be formed directly by depositing a resist material on the surface, patterning the resist with photolithography or other means and etching the underlying surface through the resist with wet or dry techniques. Surface features may also be formed directly with laser ablation and other spatially selective etch techniques.

Figure 13A:
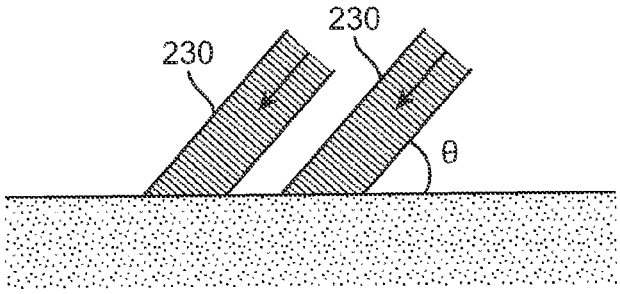
FIGS. 13A to 13F illustrate the steps of laser etching of surface topology.
Figure 13B:
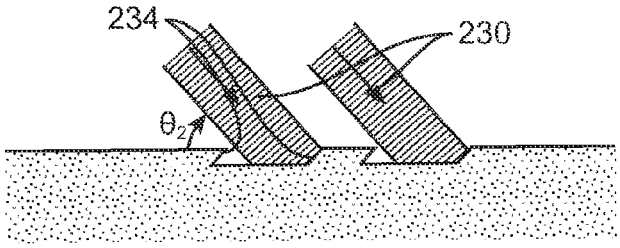
Figure 13C:
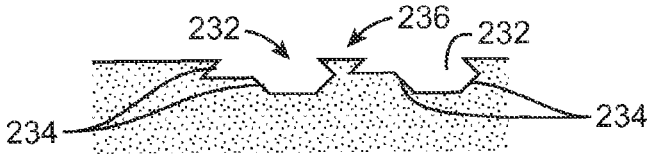
Figure 13D:
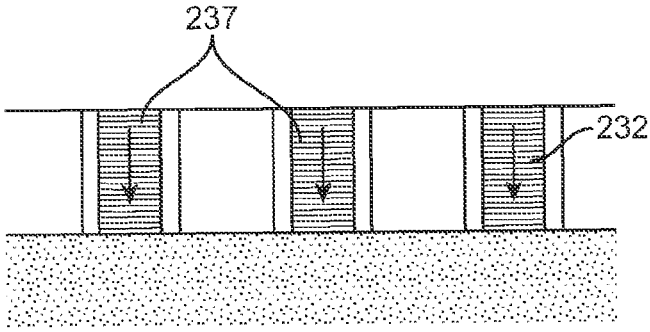
Figure 13E:
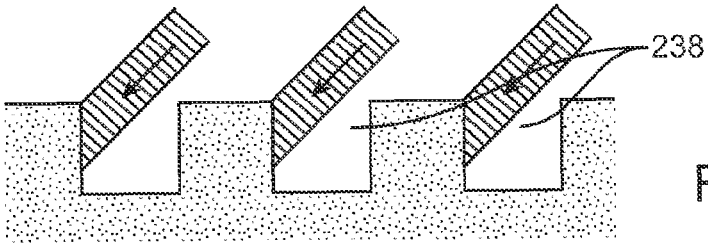
Figure 13F:
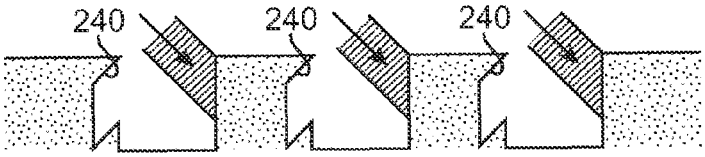

Referring now to FIG. 13A through 13F, laser ablation can also be used to form pillars on the surface. A laser beams can be split to provide many parallel paths 230 to create cavities 232 having parallel walls 234 simultaneously. By laser cutting in steps, micro pillars 236 having a variety of patterns can be achieved. As illustrated in FIGS. 13A-13C, the lasers can be sequentially directed at different angles θ relative to the surface to produce cavities having complex geometries. As illustrated in FIGS. 13D through 13F, the laser beams 230 may initially directed vertically to form cavities 238 having vertical walls, and undercuts 240 subsequently formed by directing the lasers at an angle relative to the surface.

Figure 12E:
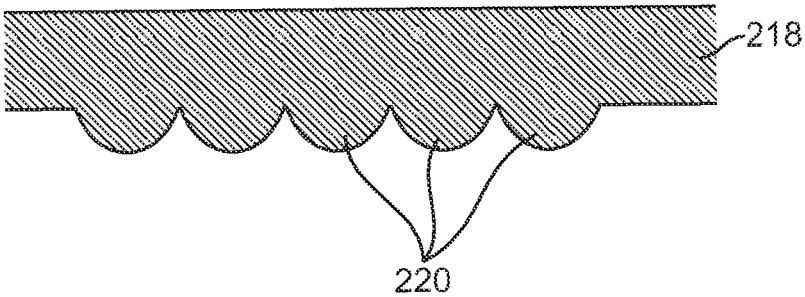
Figure 14A:
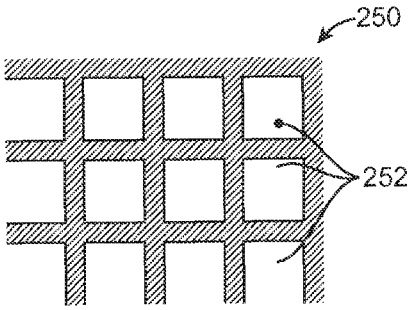
FIGS. 14A to 14F illustrate different surface topology and steps for forming such features by wet or dry etching.
Figure 14B:
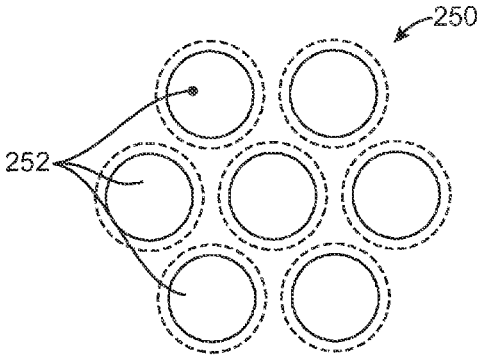
Figure 14C:
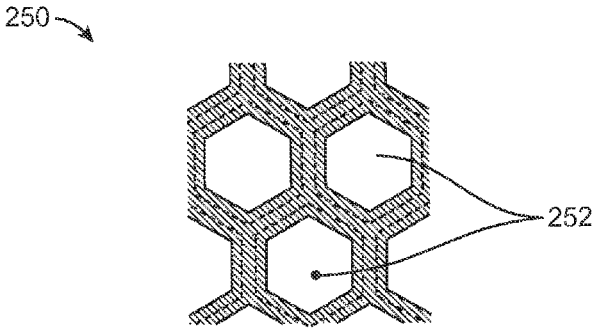

Referring now to FIGS. 14A through 14C, a screen structure 250 may be formed and used as a resistant sound port. Holes 252 of the screen 250 may have different shapes such as square (FIG. 14A), round (FIG. 14B), and hexagonal (FIG. 14C). The sidewalls of the holes may be vertical or may include overhangs (similar to those in FIGS. 13C and 13F) or have a re-entrant shape as shown in FIG. 11A or have patterned topology as shown in FIG. 12E. The screen may coated with a fluoropolymer or other hydrophobic, oleophobic coating.

Figure 14D:
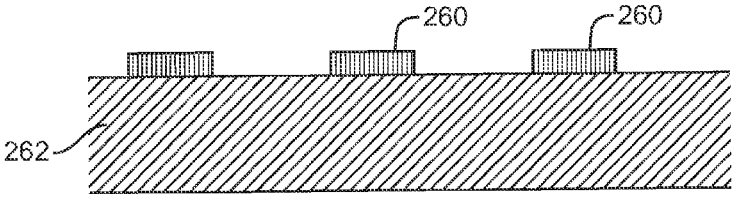
Figure 14E:
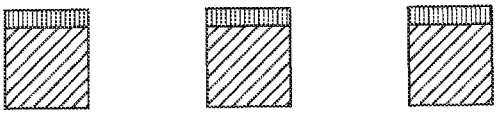
Figure 14F:
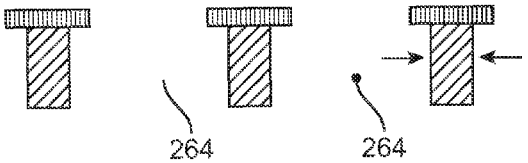

Referring now to FIG. 14D through 14F, other etching techniques can be used to pattern and form surfaces and through holes, such as using anisotropic etching with a patterned photoresist 260 over a substrate 262. Anisotropic etching by laser or plasma techniques, for example, can be used to produce holes with vertical sidewalls as shown in FIG. 14E. An extra step of isotropic etching can produce holes 264 having overhangs.

Figure 15A:
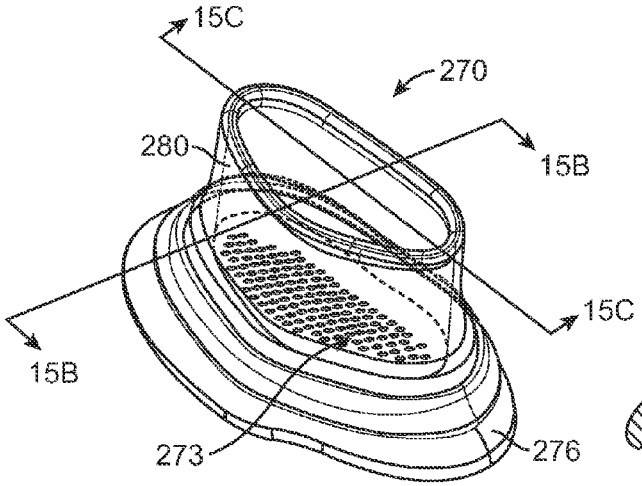
FIGS. 15A to 15D illustrate a first embodiment of a sound/air port having a screen and a wall cerumen guard.
Figure 15B:
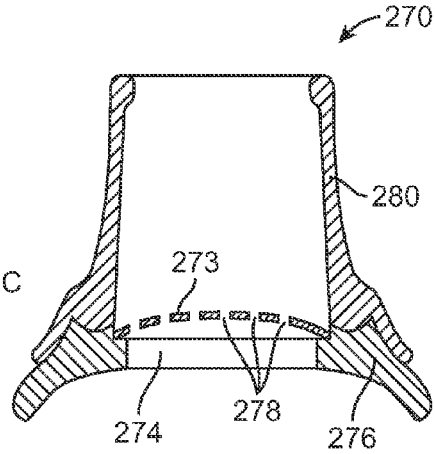
Figure 15C:
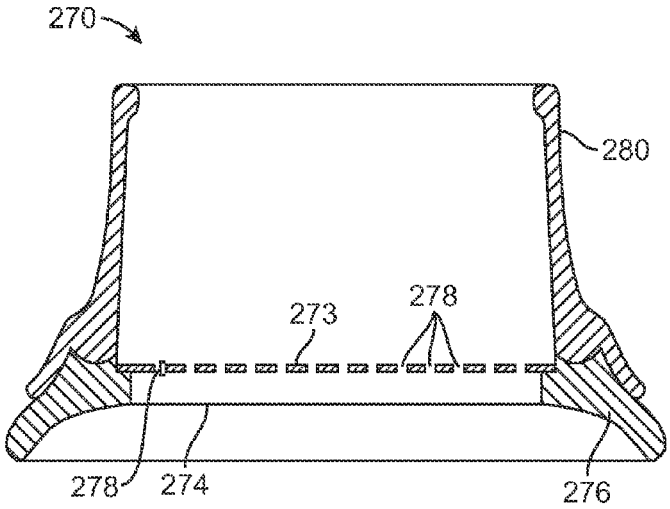

FIGS. 15A through 15C illustrate an alternate protective sound port design that can be incorporated into any of the housing and cap designs described elsewhere herein. The port 270 includes a hydrophobic and oleoresistant perforated screen 273 spanning an opening 274 in a housing 276, with further protection afforded by a flexible open-ended tube extending out from the housing. The housing may be part of the hearing device enclosure or may be part of a separate cap structure to be placed over the opening in a hearing device enclosure. The screen will typically comprise a thin metal or polymer film with a series of perforations 278 and a surface texture or treatment imparting hydrophobic and oleophobic/oleoresistant properties. The size/spacing of the perforations are chosen such that the screen is sufficiently transparent to incoming acoustic waves in the audible frequency range, while retaining the ability to repel liquid water and cerumen and prevent them from passing through the sound port and clogging internal components. An additional barrier may be provided by a flexible tube 280 attached about the circumferential edge of the opening 274. The main function of this tube is to block thick and/or solid cerumen and other solid debris from depositing on and clogging the perforations in the screen at its base.

Figure 15D:
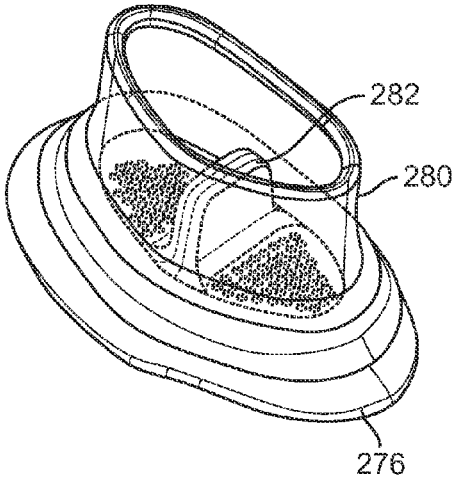

FIG. 15D depicts a sound port similar to that illustrated in FIG. 15A with a structural tab 282 bridging the opening in the housing and having a hydrophobic or oleoresistant surface treatment to help repel water and cerumen. The tab 282 is intended to aid in insertion and/or removal of the hearing device from the ear canal. Furthermore, the tab is designed so it occludes the perforated screen as little as possible. All other numbering in FIG. 15D is similar to that used in FIGS. 15A-15C.

Figure 16A:
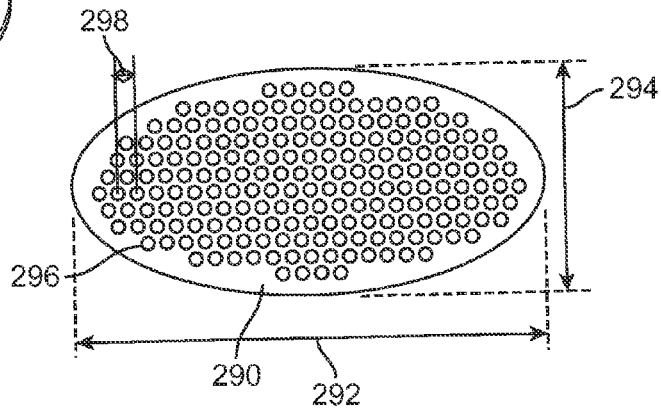
FIGS. 16A to 16B illustrate a second embodiment of a sound/air port having a screen and a wall cerumen guard.

FIG. 16A shows a preferred embodiment for a perforated screen 290 that is elliptical in shape with a major diameter 292 of 3.7 mm, a minor diameter 294 of 1.8 mm, a thickness of 50 microns, hole 296 diameters of 100 microns (typically in the range from 50 microns to 200 microns), and hole pitch 298 of 150 microns.

Figure 16B:
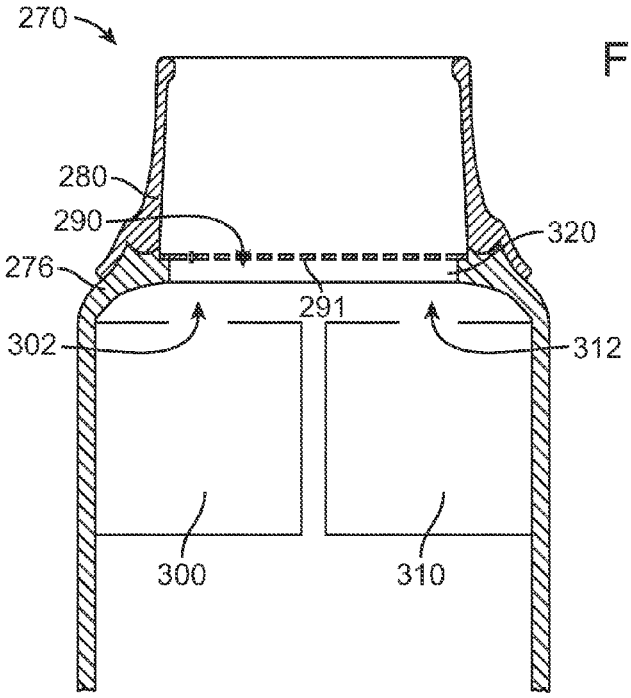

Referring now to FIG. 16B, the positional relationship between the sound port 270, microphone 300, and battery 310 at the lateral end of a hearing device assembly including wall 280 and housing 276 is depicted. In this embodiment, the microphone 300 and battery 310 input ports 302 and 312, respectively, are disposed opposite to an inner surface 291 of the perforated screen 290, and together with the screen define a fixed air cavity 320 in the interior of the hearing device. Furthermore, the openings 302 and 312 in the microphone and battery compartments may be positioned at the deepest parts of a variable-shaped cavity, while sections of the cavity away from the openings are shallower. This arrangement will tend to compel any water and/or cerumen that does manage to penetrate through the perforated screen to preferentially wick away from the microphone and battery openings.

Figure 17A:
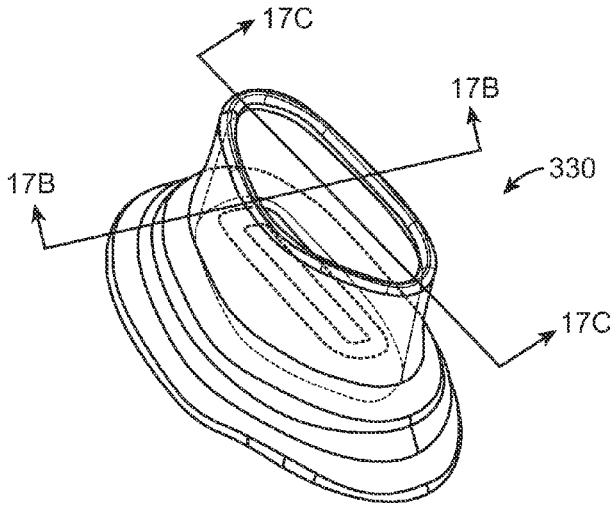
FIGS. 17A to 17D illustrate a sound/air port having a tapered slot surrounded by a wall cerumen guard.
Figure 17B:
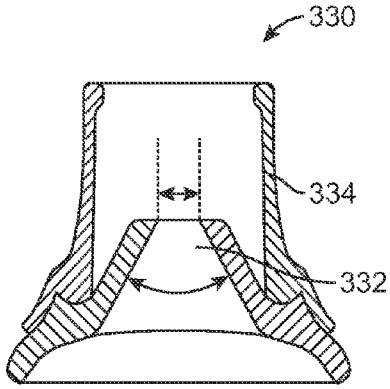
Figure 17C:
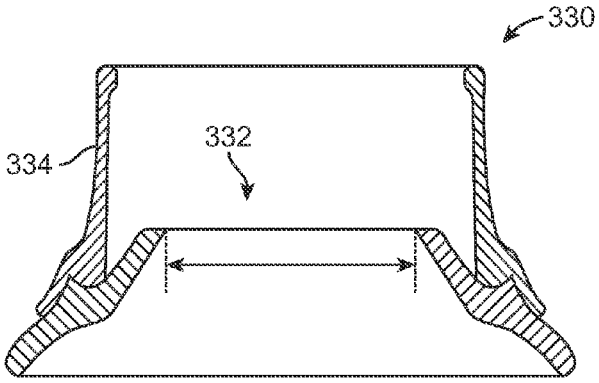

An alternate embodiment 330 of the sound port having an orthogonally oriented and inwardly flaring open air sound channel 332 coupled with a protective flexible tube 334 is illustrated in FIGS. 17A through 17C. The size and shape of the sound channel are optimized for acoustic sound transmission and minimized hearing device form factor, while preserving the contamination resistance properties of the previous embodiments. A hydrophobic and oleoresistant coating is applied to inner and outer surfaces 336 on either side of the channel 332, and the combination of this coating with the inwardly flaring slit geometry create droplet surface contact angles that make it difficult for both liquid water and cerumen to pass in through the slit from the outside. As with previous embodiments, the flexible tube 334 is attached over the slit 332 opening to prevent solid cerumen and other debris from depositing on and clogging the opening. The lateral end of the slit 332 has dimensions 2.56 mm by 0.46 mm, and a 60 degree inward flare angle. The length of the slit from the lateral to medial end is typically 1.1 mm.

Figure 17D:
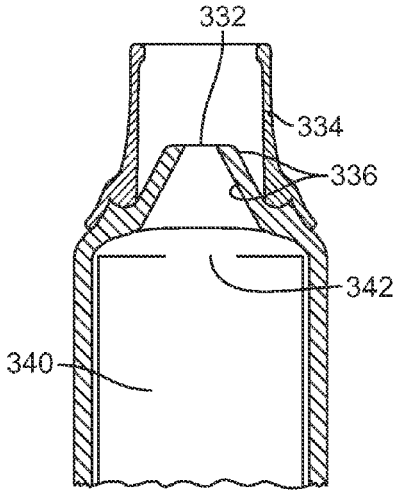

FIG. 17D illustrates a short-axis cross section showing how the sound port in FIG. 17A-17C is oriented relative to the overall hearing device assembly. As can be seen, the surfaces of the microphone and or/battery 340 face opposite to the flaring slit, and together with the slit define a partially closed cavity inside the hearing device. The slit 332 is oriented so that its narrowest section is on the outside and its widest section is closest to the internal components. To further increase the protective ability of the sound port, an opening 342 in the microphone and/or battery 342 may be located at the base of the deepest section of the partially closed fixed volume cavity, causing any liquid that does manage to pass through the slit to be preferentially channeled away from these openings.

While the above is a complete description of the preferred embodiments of the invention, various alternatives, modifications, and equivalents may be used. Therefore, the above description should not be taken as limiting the scope of the invention which is defined by the appended claims.

What is claimed is:

1. A hearing device adapted to be worn entirely within an ear canal of a patient, said device comprising:

a metal air battery;

a housing having an exterior, an interior in which the metal air battery is located, and an opening defining an air exchange path between the exterior and the interior that permits sufficient air to enter to operate the battery and permits sound transmission;

a receiver;

a microphone in the housing; and structures disposed along or across the air exchange path to inhibit the passage of liquid water or oil from the exterior to the interior of the housing.

2. A hearing device as in claim 1, wherein the structures comprise opposed wall surfaces disposed along the air exchange path wherein at least a portion of the wall surfaces are hydrophobic and at least a portion are oleophobic.

3. A hearing device as in claim 2, wherein the wall surfaces are angled to converge in a direction toward the opening.

4. A hearing device as in claim 2, wherein the opposed walls are present in the opening in the housing.

5. A hearing device as in claim 2, wherein the wall surfaces have surface features which provide a capillary barrier to the entrance of water and oil.

6. A hearing device as in claim 5, wherein the surface features comprise micropillars.

7. A hearing device as in claim 5 wherein the side walls diverge in a direction away from the opening.

8. A hearing device as in claim 5, wherein the surface features comprise ridges having exposed rounded surfaces.

9. A hearing device as in claim 5, wherein the surface features comprise holes.

10. A hearing device as in claim 2, wherein the opposed wall surfaces are coated with a material which is both hydrophobic and oleophobic.

11. A hearing device as in claim 10, wherein the material is a fluoropolymer.

12. A hearing device as in claim 10, wherein the opposed walls are chemically or plasma treated.

13. A hearing device as in claim 1, wherein the opposed walls are present in a separate cap which is disposed over the opening in the housing.

14. A hearing device as in claim 13, wherein the cap comprises a base having a central opening, wherein the capillary barrier extends across the central opening.

15. A hearing device as in claim 1, further comprising a cap which is disposed over the opening in the housing, said cap having a capillary barrier which allows air exchange and inhibits water and cerumen intrusion into the opening in the housing.

16. A hearing device as in claim 15, wherein the capillary barrier comprises a screen with a hydrophobic and oleophobic surface.

17. A hearing device as in claim 16, wherein the screen has a hydrophobic and oleophobic coating.

18. A hearing device as in claim 7, wherein the coating comprises a fluoropolymer.

19. A hearing device as in claim 1, further comprising a tubular structure surrounding the opening to block the entry of solid cerumen and other debris.

20. A hearing device as in claim 19, wherein the tubular structure is elastomeric.

21. A hearing device adapted to be worn entirely within an ear canal of a patient, said device comprising:

a housing having an exterior, an interior, and an opening defining an air exchange path between the exterior and the interior;

at least one of a receiver, a battery assembly, and a microphone assembly positioned within the housing; and a cap which is disposed over the opening in the housing, the cap including screen, with a hydrophobic and oleophobic surface and openings with a width in the range from 50 microns to 200 microns, which allows air exchange and inhibits the passage of liquid water, oil and cerumen intrusion from the exterior to the interior of the housing.

22. A hearing device adapted to be worn entirely within an ear canal of a patient, said device comprising:

a metal air battery;

a housing having an exterior, an interior in which the metal air battery is located, and an opening defining an air exchange path between the exterior and the interior that permits sufficient air to enter to operate the battery:

a receiver and a microphone;

structures disposed along or across the air exchange path to inhibit the passage of liquid water or oil from the exterior to the interior of the housing; and a rigid barrier having a plurality of holes to block the entry of solid cerumen and other debris.

23. A method of improving a patient's hearing, said method comprising:

positioning a hearing device within an ear canal of the patient, wherein at least a portion of the device resides beyond the bony junction and wherein the device has at least one opening in a wall of a housing that is susceptible to water and cerumen contamination; and providing a barrier which inhibits the intrusion of water and cerumen into said opening while permitting air sufficient exchange through said opening to allow functioning of an air-metal battery and sufficient to allow sound waves to enter an interior of the housing which includes a receiver.

24. A method as in claim 23, wherein the hearing device is left in the ear canal for at least 15 days before removing said device from the ear canal.

25. A method as in claim 23, wherein providing comprises placing a screen across the air exchange path.

26. A method of improving a patient's hearing, said method comprising:

positioning a hearing device within an ear canal of the patient, wherein at least a portion of the device resides beyond the bony junction and wherein the device has at least one opening in a wall of a housing that is susceptible to water and cerumen contamination; and forming micropillars or ridges on a pair of surfaces on opposite sides of the air exchange path which inhibit the intrusion of water and cerumen into said opening while permitting air exchange through said opening.

27. A method of improving a patient's hearing, said method comprising:

positioning a hearing device within an ear canal of the patient, wherein at least a portion of the device resides beyond the bony junction and wherein the device has at least one opening in a wall of a housing that is susceptible to water and cerumen contamination; and positioning a cap over the opening, that provides a capillary barrier which inhibits the intrusion of water and cerumen into said opening while permitting air sufficient exchange through said opening to allow functioning of an air-metal battery.

28. A hearing device defining a medial end and a lateral end and adapted to be worn entirely within an ear canal of a patient, the hearing device comprising:

a receiver, a metal-air battery including an input port that is located adjacent to the lateral end of the hearing device, and a microphone including an input port that is located adjacent to lateral end of the hearing device; and a screen positioned adjacent to and lateral of the metal-air battery input port and the microphone input port, the screen being configured to permit sound transmission and the passage of sufficient air to enter to operate the battery and to inhibit the passage of liquid water and oil into the metal-air battery input port and the microphone input port.

29. A hearing device as claimed in claim 28, wherein the screen has a plurality of holes that are 50 to 200 microns in width.

30. A hearing device as claimed in claim 28, wherein the microphone, the metal-air battery and the screen together define a variable-shaped cavity with a deepest part; and the microphone input port and the battery input port are positioned at the deepest part of the variable-shaped cavity.

31. A hearing device as claimed in claim 28, wherein the screen comprises a perforated thin metal or polymer film.

32. A hearing device as claimed in claim 28, wherein the screen has hydrophobic and oleophobic properties.

33. A hearing device as claimed in claim 28, wherein the screen is elliptical in shape.

34. A hearing device as claimed in claim 28, further comprising:

a cap on which the screen is carried.

35. A hearing device as claimed in claim 28, further comprising:

a tubular structure surrounding the screen, and extending laterally therefrom, that prevents solid cerumen and other debris from depositing on the screen.

36. A hearing device as claimed in claim 35, wherein the tubular structure is elastomeric.

* * * * *